US010961973B2

(12) United States Patent
Shah

(10) Patent No.: US 10,961,973 B2
(45) Date of Patent: Mar. 30, 2021

(54) SPARK PLUG ELECTRODE WEAR RATE DETERMINATION FOR A SPARK-IGNITED ENGINE

(71) Applicant: Caterpillar Energy Solutions GmbH, Mannheim (DE)

(72) Inventor: Darshit Shah, Mannheim (DE)

(73) Assignee: Caterpillar Energy Solutions GmbH, Mannheim (DE)

( * ) Notice: Subject to any disclaimer, the term of this patent is extended or adjusted under 35 U.S.C. 154(b) by 0 days.

(21) Appl. No.: 16/413,105

(22) Filed: May 15, 2019

(65) Prior Publication Data

US 2019/0376486 A1 Dec. 12, 2019

(30) Foreign Application Priority Data

Jun. 7, 2018 (EP) ..... 18176511

(51) Int. Cl.
*H01T 13/58* (2020.01)
*F02P 17/10* (2006.01)
(Continued)

(52) U.S. Cl.
CPC ..... *F02P 17/12* (2013.01); *F02P 3/053* (2013.01); *F02P 17/10* (2013.01); *H01T 13/58* (2013.01);
(Continued)

(58) Field of Classification Search
CPC ..... F02P 17/10; F02P 17/12; F02P 17/121; H01T 13/58; H01T 13/60
(Continued)

(56) References Cited

U.S. PATENT DOCUMENTS 6,736,113 B1 5/2004 Ott
2004/0085070 A1* 5/2004 Daniels ..... F02D 35/027 324/391
(Continued)

FOREIGN PATENT DOCUMENTS

DE 102011115735 A1 5/2012
DE 102011005651 A1 9/2012
(Continued)

OTHER PUBLICATIONS

European Search Report for related Application No. 18176511.6; dated Nov. 27, 2018.

*Primary Examiner* — Erick R Solis

(57) ABSTRACT

A method for determining the wear rate of a spark plug electrode of an ignition system of an internal combustion engine comprises determining a risetiine number indicating the time required for raising the current and thereby the primary energy which is supplied to an ignition coil of the spark plug from an inactive level to a predetermined level, determining an operating condition indicator configured to indicate an operating condition of the ignition system, determining a wear rate of the spark plug electrode based on a difference of a first spark plug state indicator at a first time instance and a second spark plug state indicator at a second time instance, wherein the first time instance and the second time instance are separated by a predetermined time interval, wherein the spark plug state indicator is determined as a value based on the risetime number and the operating condition indicator.

16 Claims, 6 Drawing Sheets

(51) Int. Cl.
*F02P 17/12* (2006.01)
*F02P 3/05* (2006.01)
*H01T 13/60* (2011.01)

(52) U.S. Cl.
CPC ..... *H01T 13/60* (2013.01); *F02P 2017/121* (2013.01)

(58) Field of Classification Search
USPC ..... 123/169 R, 169 EL, 630; 73/114.62
See application file for complete search history.

(56) References Cited

U.S. PATENT DOCUMENTS

2007/0186903 A1* 8/2007 Zhu ..... F01N 3/2006 123/406.37
2014/0048039 A1* 2/2014 Louven ..... F02P 17/12 123/406.12
2015/0112573 A1* 4/2015 Huberts ..... F02P 17/12 701/102
2015/0176558 A1* 6/2015 Glugla ..... F02P 17/12 123/294
2016/0084214 A1* 3/2016 Okuda ..... F02D 37/02 123/478
2016/0138553 A1* 5/2016 Senior ..... G01M 15/11 73/114.62
2017/0284358 A1 10/2017 Skowronek et al.
2018/0119665 A1* 5/2018 Glugla ..... F02P 11/00
2019/0301423 A1* 10/2019 Petruska ..... F02P 3/0456

FOREIGN PATENT DOCUMENTS

DE 102012010177 A1 11/2012
DE 102015208388 A1 11/2016
EP 1835172 A1 9/2007
EP 33306075 A1 4/2018
FR 2687255 A1 8/1993
FR 2768186 A1 3/1999
JP 2014-017153 A 1/2014

* cited by examiner

SPARK PLUG ELECTRODE WEAR RATE DETERMINATION FOR A SPARK-IGNITED ENGINE

CROSS-REFERENCE TO RELATED APPLICATION

This application claims priority under 35 USC § 119 and the Paris Convention to European Patent Application No. 18176511.6 filed on Jun. 7, 2018.

TECHNICAL FIELD

The present disclosure generally relates to an ignition system such as in an internal combustion engine. More particularly, the present disclosure relates to a method for determining the wear rate of a spark plug electrode of the ignition system and an ignition system for an internal combustion engine configured to perform the method for determining the wear rate of a spark plug electrode.

BACKGROUND

In order to initiate combustion of a compressed fuel-air-mixture in a cylinder of a reciprocating spark-ignition (SI) engine, in particular for engines operating on gaseous fuel, a spark plug for generating a spark arc based on external energy supply is required. In general, the spark plug is provided with two electrodes between which the spark arc is to be generated. Depending on the engine operating conditions, the state of an ignition coil and the state of the spark plug electrodes, a definite minimum energy is required to ignite the fuel-air-mixture inside the cylinder. This definite minimum energy generally leads to high electrode temperatures and, as a consequence, to an erosion of the electrodes. Electrode erosion could be measured in form of wear and could be used for monitoring the state of a spark plug and determining the wear of a spark plug, for instance, in order to decide whether the spark plug has to be replaced or not.

An exemplary apparatus and method for determining the wear rate of a spark plug of an internal combustion engine by use of wear determination means is disclosed in EP 1 835 172 A2. The wear determination means determine a current wear of a spark plug based on operating conditions of the internal combustion engine and add this current wear to a total wear state of the spark plug.

The present disclosure is directed, at least in part, to improving or overcoming one or more aspects of prior systems.

SUMMARY OF THE DISCLOSURE

In one aspect, a method for determining the wear rate of a spark plug electrode of an ignition system including a spark plug of an internal combustion engine is disclosed. The method comprises determining a risetime number depending on or indicating the time required for raising an ignition energy (energy in form of current) which is supplied to an ignition coil of the spark plug from an inactive level to a predetermined level and determining an operating condition indicator configured to indicate or be dependent on an operating condition of the ignition system. The method further comprises determining a spark plug state indicator as a value based on the determined risetime number and the determined operating condition indicator, wherein at least two for example successive spark plug state indicators are stored in a memory at predetermined time intervals, and determining a wear rate of the spark plug based on a difference of the actual (a first) spark plug state indicator indicating the spark plug electrode state at a first time instance and a second (for instance, the previous) spark plug state indicator indicating the spark plug electrode state at a second time instance, wherein the first time instance and the second time instance are separated by the predetermined time interval.

In another aspect, an ignition system for an internal combustion engine is disclosed. The ignition system comprises at least one spark plug, an ignition coil for the at least one spark plug and a control unit electronically connected to the ignition coil and configured to perform the method according to the above aspect.

In yet another aspect, an internal combustion engine, specifically an internal combustion engine working on gaseous fuel, is disclosed. The internal combustion engine comprises a plurality of cylinders each defining a combustion chamber therein for igniting fuel, a plurality of injectors each one being assigned to a respective cylinder for injecting fuel, and an ignition system according to the above aspect.

In yet another aspect, a computer program is disclosed. The computer-program comprises computer-executable instructions which, when run on a computer, cause the computer to perform the steps of the method according to the above aspect.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1:
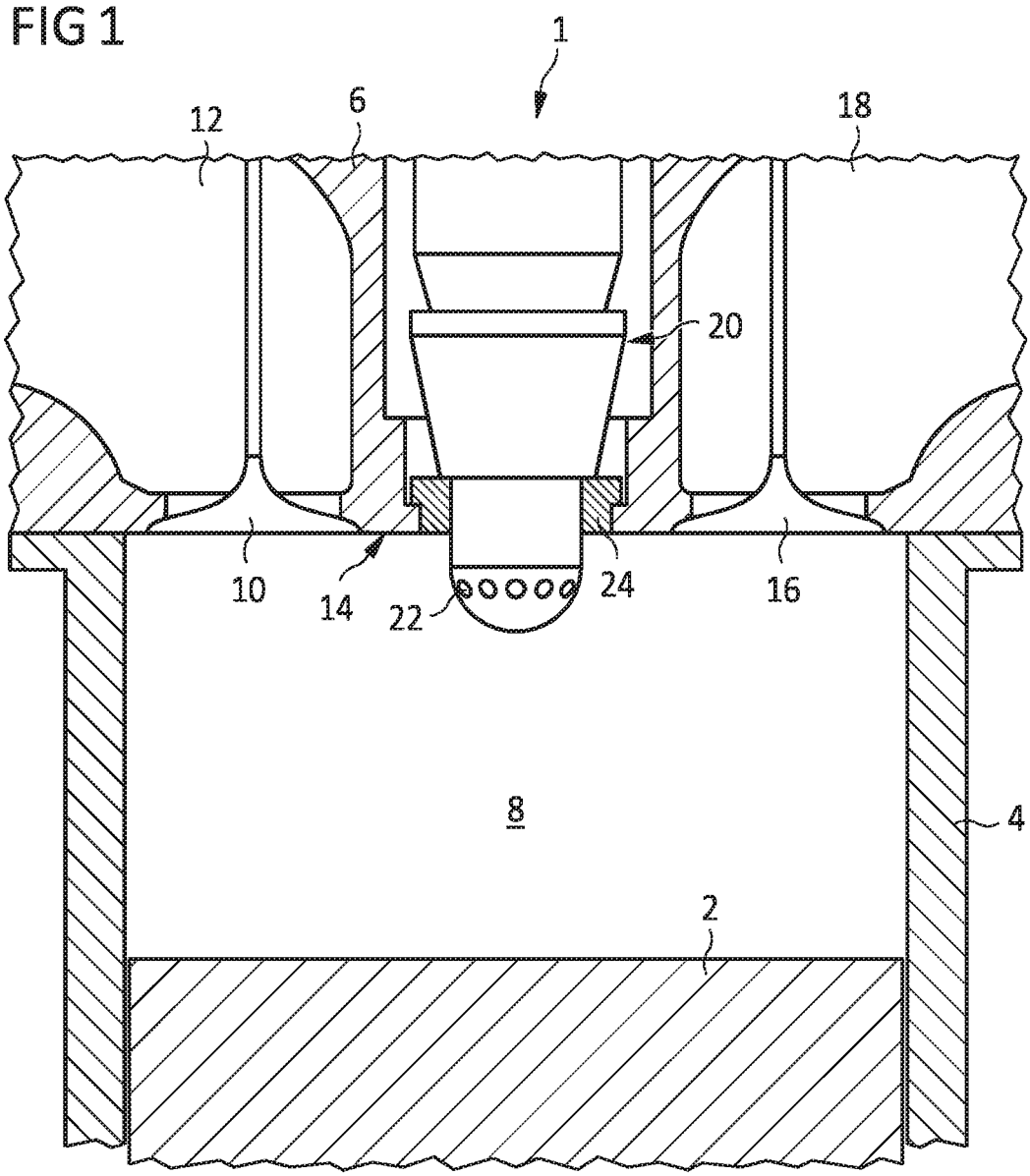
FIG. 1 shows a schematic cut view through a portion of an internal combustion engine that is equipped with a pre-chamber.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure is based in part on the realization that the performance and the efficiency of an ignition system of an internal combustion engine operating on gaseous fuel depends inter alia on the state of the spark plug electrodes mounted in the ignition system of the internal combustion engine. Spark plug electrodes are subjected to wear due to high temperatures at the spark plug electrodes in the event of igniting a fuel-air-mixture inside a cylinder of the internal combustion engine. The high temperatures result in an erosion of the electrodes what again results in a changed, usually increased, distance between the electrodes. The increasing distance between the electrodes requires higher breakdown voltages, stronger electric fields and hence more ignition energy for igniting the fuel-air-mixture inside the cylinder. In worst case, the distance between the electrodes is so that large that no spark arc is generated and, thus, the fuel-air-mixture inside the cylinder is not ignited. Accordingly, in general, a spark plug with a high wear rate requires more ignition energy and, thus, a higher secondary voltage for igniting the fuel-air-mixture inside a cylinder than a spark plug with no or a low wear rate. That is, the higher the wear rate of a spark plug, the worse are the ignition conditions and, thus, the higher is the risk for abnormal combustion and sub-optimal engine operation. In worst case, the wear of the spark plug electrodes is that excessive that the available energy does not suffice for igniting the fuel-air-mixture in the cylinder. Consequently, the wear rate of a spark plug electrode has to be monitored in order to determine timely that a spark plug has to be replaced and, thus, to assure optimum engine performance.

The present disclosure suggests a method for determining the wear rate of a spark plug electrode of an ignition system. An ignition system generally comprises a control unit, an ignition coil and a spark plug. The spark plug is generally provided with two electrodes. The method allows the determination of wear of a spark plug electrode in a defined time period. The wear of a spark plug electrode in a defined time period is called a spark plug wear rate. To determine the spark plug electrode wear rate, the method frequently determines at predetermined time intervals the state of a spark plug and, thus, determines in real-time how much the spark plug is subjected to wear until now. Afterwards, the method determines based on a difference of two spark plug state indicators how much the electrodes have been subjected to wear in this time interval. The spark plug state indicators may correspond to two subsequent spark plug state indicators, but may also correspond to spark plug state indicators which are not directly successive to each other. For example, also the first spark plug state indicator may be compared with the third spark plug state indicator or the second spark plug state indicator may be compared to the fourth spark plug state indicator and so on. The result of this determination corresponds to the wear rate per time unit and may allow the prediction of the lifespan of the concerned spark plug. For determining the spark plug electrode wear rate, a predetermined number of spark plug state indicators, at least two for example successive spark plug state indicators have to be stored in a memory (preferably a nonvolatile memory). It is preferred to store the last five spark plug state indicators which have been determined.

The time interval in which the spark plug electrode state is determined corresponds to a trigger time interval and may be chosen dependent on how accurate the spark plug has to be monitored. In the present disclosure, the term "trigger" means the event when the state of the spark plug is monitored (i.e., the time span). For instance, the accuracy of monitoring the spark plug may depend on the kind of internal combustion engine (stationary engine for producing electrical energy, internal combustion engine of a vehicle, etc.), the operating condition of the internal combustion engine (idle running, slow running, fast running, etc.), manufacturer's instructions, and the like, but stays preferably constant during an entire spark plug electrode state determination cycle. Preferably, a spark plug electrode state determination cycle extends from mounting to exchanging of a spark plug. However, a spark plug electrode state determination cycle may also depend on different operating conditions of the internal combustion engine. The spark plug electrode state is determined and stored in the memory periodically and, thus, at regular intervals like intervals between 1 and 600 minutes, specifically between 30 and 90 minutes, for example between 40 and 90 minutes.

The determination of the spark plug state indicator may be based on a non-dimensional risetime number and an operating condition indicator which are stored in a 3D look-up map in form of a fraction value. The map may be calibrated based on fundamental investigation, accelerated testing and actual behavior of spark plugs over the time. Further, the calibration of the map may vary depending on the engine type and application and/or the ignition system type.

The risetime number is the time which is required to raise the primary current supplied to the ignition coil from an inactive level to a predefined level. The risetime number is contained in an electronic control module (ECM) as a cylinder individual cyclic feedback for each ignition cycle. The risetime number may be a non-dimensional number which is preferably based on a statistical mean value and a standard deviation (variance), in order to combine the effect of both a mean value and a standard deviation. Non-dimensional numbers generally have the advantage that they allow an assessment of a situation in an easy and quick manner.

The determination of an operating condition indicator allows an indication of the operating condition of the internal combustion engine. For determining the operating condition indicator various conditions of the internal combustion engine may be considered, such as the operating load, the operating temperatures, the operating pressures, intake air conditions, etc. Preferably, the operating condition indicator corresponds to the density of the fuel-air-mixture in the cylinder at the time of ignition and, thus, corresponds to the mixture density at the time of ignition. This density of the fuel-air mixture may preferably be calculated based on the initial density of the fuel-air-mixture and the ignition angle, i.e., the crank shaft angle at which the ignition of the fuel-air-mixture takes place. The initial density of the fuel-air-mixture may preferably be calculated based on the pressure and the temperature at the intake manifold which are both measured by use of suitable sensors. However, it is noted that the initial density may also be calculated based on other operating conditions of the internal combustion engine (e.g. by means of a mass flow sensor). The ignition angle may be determined in real-time or based on a look-up table.

In the following, it is referred to the drawings to explain the general principle of the present disclosure by way of example. FIG. 1 depicts a piston 2 arranged in a cylinder 4 of a portion of an internal combustion engine 1 (not shown in further detail). The cylinder 4 is covered by a cylinder head 6. The piston 2, the cylinder 4, and the cylinder head 6 together define a main combustion chamber 8 of the internal combustion engine 1. The piston 2 is reciprocating in the cylinder 4 to move between a top dead center (TDC) and a bottom dead center (BDC) during operation of the internal combustion engine 1.

For the purpose of describing exemplary embodiments of the present disclosure, the internal combustion engine 1 is considered as a four-stroke stationary or marine internal combustion engine operating at least partly on gaseous fuel such as a gaseous fuel engine or a dual fuel engine. One skilled in the art will appreciate, however, that the internal combustion engine may be any type of engine (turbine, gas, diesel, natural gas, propane, two-stroke, etc.) that would utilize the spark plug diagnostics as disclosed herein. Furthermore, the internal combustion engine may be of any size, with any number of cylinders, and in any configuration (V-type, in-line, radial, etc.). Moreover, the internal combustion engine may be used to power any machine or other device, including locomotive applications, on-highway trucks or vehicles, off-highway trucks or machines, earth moving equipment, generators, aerospace applications, marine applications, pumps, stationary equipment, or other engine powered applications. The internal combustion engine 1 may use a pre-mixed fuel air mixture supplied to the cylinder 4 via inlet channels, or may directly inject a fuel into the cylinder 4.

The cylinder head 6 includes at least one inlet valve 10, for example a poppet valve. The inlet valve 10 is accommodated in an inlet channel 12 opening in a piston sided face 14 of the cylinder head 6 for supplying a mixture of gaseous fuel and air into the main combustion chamber 8. Similarly, at least one outlet valve 16, for example also a poppet valve, is accommodated in an outlet channel 18 of the cylinder head 6 to guide exhaust gas out of the main combustion chamber 8.

The cylinder head 6 further comprises a pre-chamber assembly 20 A plurality of flow transfer channels 22 fluidly connect the main combustion chamber 8 with an interior of the pre-chamber assembly 20 (not visible in FIG. 1).

The pre-chamber assembly 20 is installed in the cylinder head 6 via a mounting body 24 as shown in FIG. 1. Alternatively, the pre-chamber assembly 20 may be installed in the cylinder head 6 in any other fashion.

Figure 2:
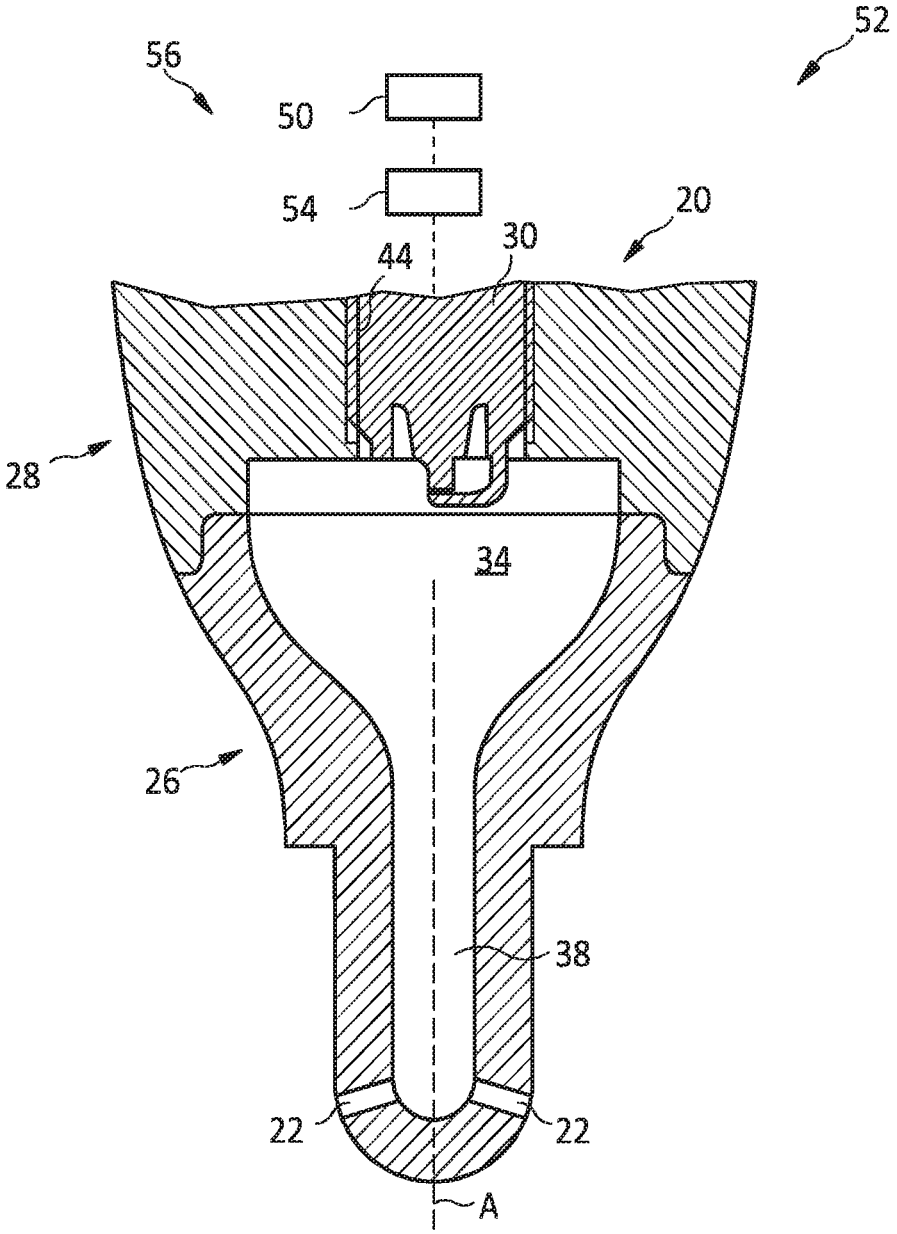
FIG. 2 shows a schematic cut view through an exemplary pre-chamber assembly including a spark plug.

Referring to FIG. 2, the pre-chamber assembly 20 is shown in a schematic sectional view. The pre-chamber assembly 20 includes a first pre-chamber body 26, a second pre-chamber body 28, and a spark plug 30. In some embodiments, the pre-chamber assembly 20 may further comprise a fuel supply device for enriching a pre-chamber 34 of the pre-chamber assembly 20.

The first pre-chamber body 26 and the second pre-chamber body 28 are connected to one another. The spark plug 30 is accommodated in the second pre-chamber body 28

The first pre-chamber body 26 includes and defines the pre-chamber 34, a riser channel 38 and the flow transfer channels 22. In an assembled state, the flow transfer channels 22 fluidly connect an interior of the pre-chamber body 26 (the pre-chamber 34 and the riser channel 38) and the main combustion chamber 8 (FIG. 1).

The pre-chamber 34 extends along a longitudinal axis A of the first pre-chamber body 26, is funnel-shaped, and tapers in direction to the riser channel 38. Alternatively, the pre-chamber 34 may have any other shape such as a cylindrical shape, pyramidal shape, conical shape, and combinations thereof. For example, the pre-chamber 34 may have a volume within a range between 0.1% and 10% of the compression volume of the cylinder 4 (see FIG. 1).

The spark plug 30 is installed in the pre-chamber assembly 20 so that the spark plug 30 is operably coupled to the pre-chamber 34. Particularly, electrodes of the spark plug 30 may reach into the pre-chamber 34 so that a spark between the electrodes ignites a mixture in the pre-chamber 34.

In some embodiments, a pre-chamber 34 may be omitted and/or the spark plug 30 may reach into the main combustion chamber 8 of the internal combustion engine 1. For example, the spark plug 30 may be a main combustion chamber spark plug, a pre-chamber spark plug, a chamber plug (including an integrated chamber for shielding the electrodes), a ring-type spark plug, a j-type spark plug, etc.

An ignition system 56 includes a control unit 50, an ignition coil 54, and the spark plug 30. In some embodiments, the ignition coil 52 may be integrated into the spark plug 30.

The control unit 50 is electronically connected to the ignition coil 54 which in turn is electronically connected to the spark plug 30. The control unit 50 is configured to actuate the ignition system 56. The control unit 50 may be further configured to adapt an operation of the internal combustion engine 1, for example adapting an engine speed, adapting a charge air pressure, adapting a fuel supply, adapting a timing of a fuel supply and an ignition, etc. The control unit 50 and/or the ignition system 56 may be a part of a control system 52 further including the electrical connections to the components.

The control unit 50 may be a single microprocessor or multiple microprocessors that include means for controlling, among others, an operation of various components of the internal combustion engine 1. The control unit 50 may be a general engine control unit (ECU) capable of controlling the internal combustion engine 1 and/or its associated components or a specific engine control unit dedicated to the ignition system 56. The control unit 50 may include all components required to run an application such as, for example, a memory, a secondary storage device, and a processor such as a central processing unit or any other means known in the art for controlling the internal combustion engine 1 and its components. Various other known circuits may be associated with the control unit 50, including power supply circuitry, signal conditioning circuitry, communication circuitry and other appropriate circuitry. The control unit 50 may analyze and compare received and stored data and, based on instructions and data stored in memory or input by a user, determine whether action is required. For example, the control unit 50 may compare received values with target values stored in memory, and, based on the results of the comparison, transmit signals to one or more components to alter the operation status of the same.

The control unit 50 may include any memory device known in the art for storing data relating to an operation of the internal combustion engine 1 and its components. The data may be stored in the form of one or more maps (mappings). Each of the maps may be in the form of tables, graphs and/or equations, and may include a compilation of data collected from lab and/or field operation or simulations of the internal combustion engine 1. The maps may be generated by performing instrumented tests on the operation of the internal combustion engine 1 under various operating conditions while varying parameters associated therewith or performing various measurements. The control unit 50 may reference these maps and control operation of one component in response to the desired operation of another component. For example, the maps may contain data on the spark plug electrode state depending on a specific combination of an operation value of an electrical parameter of the spark plug 30 and operating conditions of the internal combustion engine 1.

The control unit 50 is further configured to perform the method for determining the wear rate of the electrodes of the spark plug 30 of the ignition system 56 as disclosed herein, in particular, the method as described in the following with respect to FIGS. 3 to 7.

Figure 3:
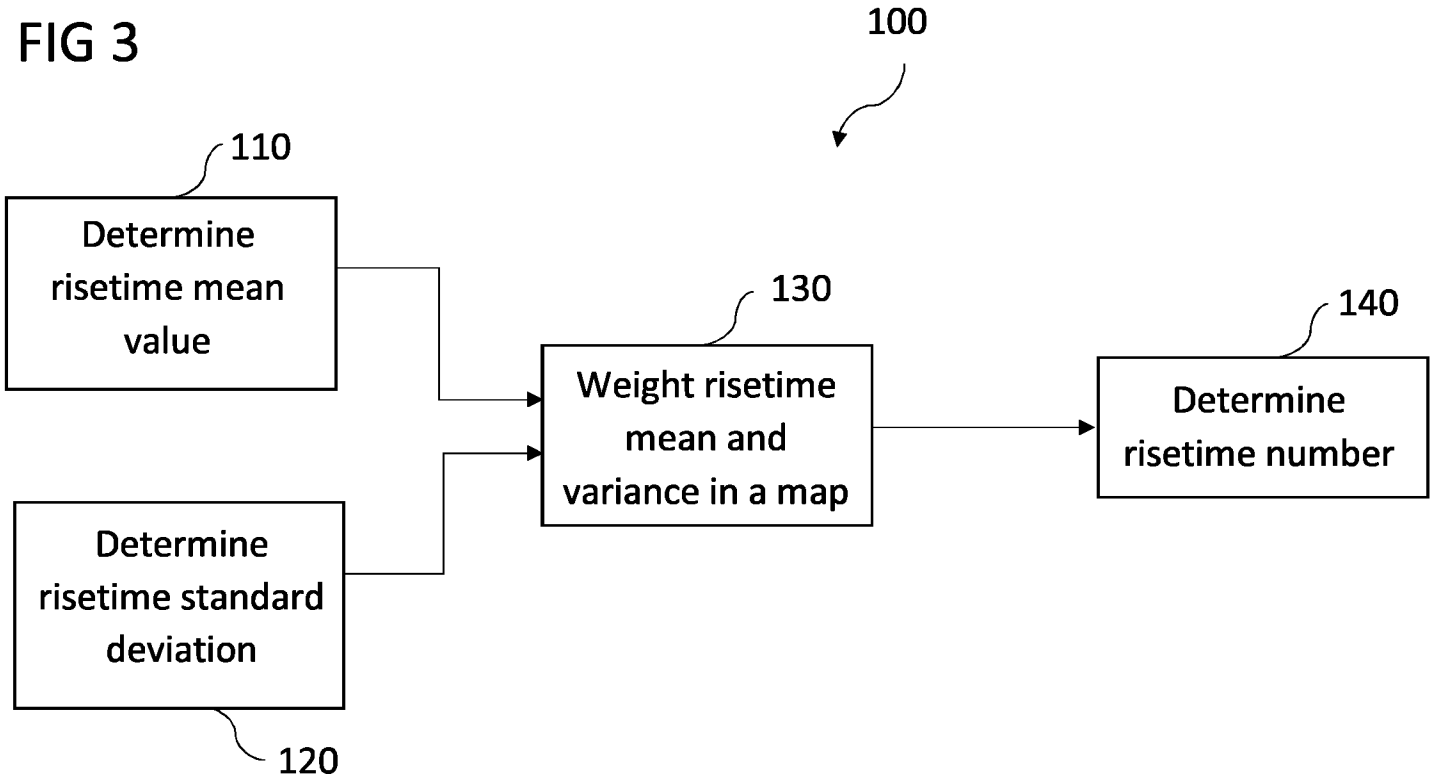
FIG. 3 shows a process chart for determining of a risetime number according to the present disclosure.

FIG. 3 shows a process chart illustrating the first step 100 of determining the wear rate of the electrode of a spark plug 30 according to the present disclosure, namely the determining of a risetime number in step 140. The risetime number is determined based on a determination of a risetime mean value in step 110 and a determination of a risetime standard deviation (variance) in step 120. In general, the risetime is the time which is required for raising the primary current supplied to the ignition coil 54 from an inactive, switched-off level to a predefined level and is measured in microseconds. The predefined level usually corresponds to the level which allows the breakdown of the magnetic field generated by the ignition coil, the generation of a high voltage impulse and a quick transition from glow discharge to arc discharge at the two spark plug electrodes. The risetime mean value corresponds to an average time which is required to raise the ignition coil current from an inactive level to a predefined level which is necessary to generate the high voltage impulse. The average time is determined over various ignition cycles by the electronic control module, i.e., over various cycles in which a fuel-air-mixture inside the cylinder is ignited.

After having determined the risetime mean value and the risetime standard deviation, in step 130, both the risetime mean value and the risetime standard deviation are weighted in a map, for example, a characteristic diagram. In step 140, the risetime number may be determined based on the map. As both the risetime mean value and the risetime standard deviation are set in relation to each other, the rise time number has no dimension what simplifies the assessment of the rise time.

Figure 4:
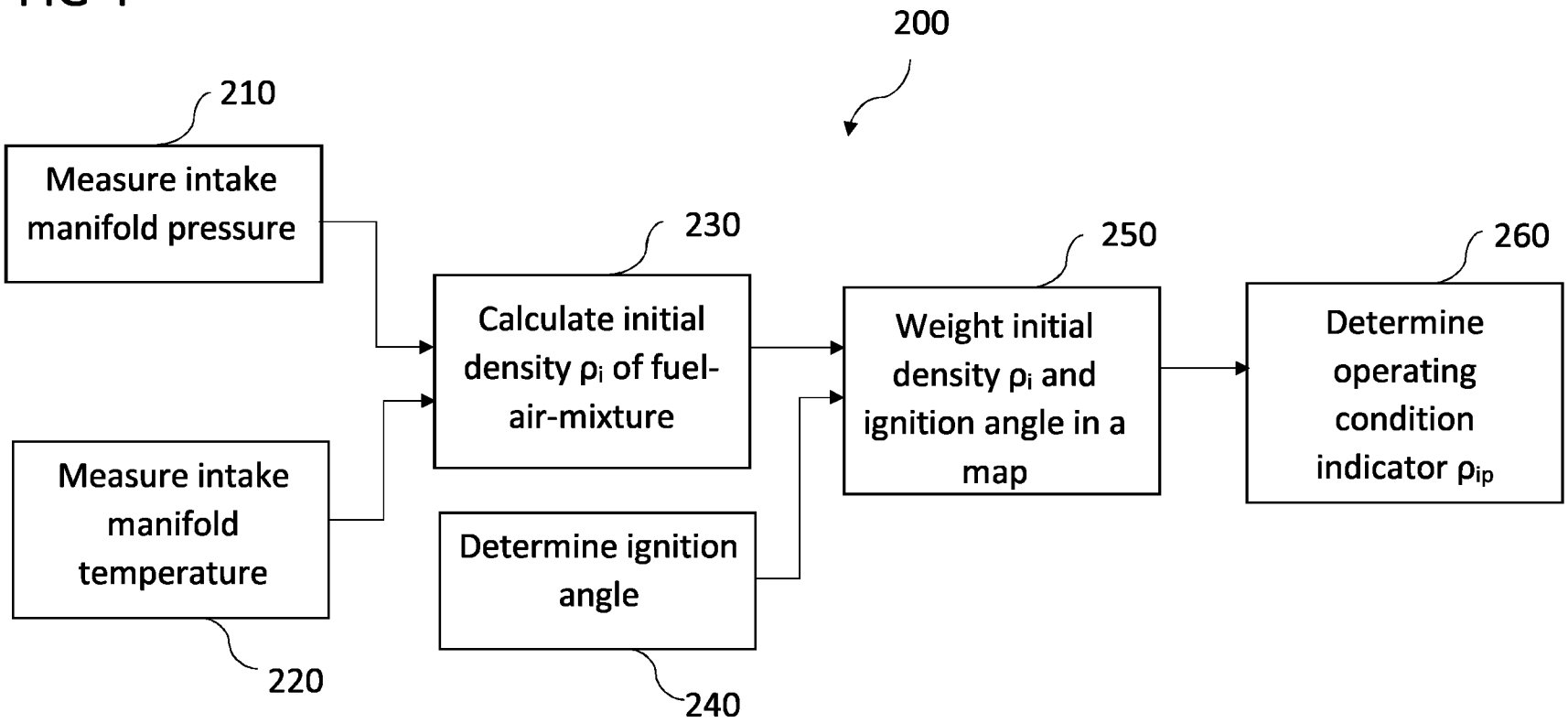
FIG. 4 shows a process chart for determining an operating condition indicator according to the present disclosure.

FIG. 4 shows a process chart illustrating the second step 200 of determining the wear rate of the electrode of the spark plug 30 according to the present disclosure, namely determining an operating condition indicator in step 260. The operating condition indicator may correspond to density at ignition point $\rho_{ip}$ of the fuel-air-mixture at, the ignition time and may be based on the calculation of an initial density pi of the fuel-air-mixture at step 230, i.e., the density of the fuel-air-mixture in intake manifold and the determination of the ignition angle at step 240, i.e., the angle of the crank shaft at which the ignition occurs, usually measured by a suitable sensor device. As shown in FIG. 3, the calculation of the initial density pi in step 230 may be based on the pressure (step 210) and the temperature (step 220) of the fuel-air-mixture at the intake manifold.

After having calculated the initial density pi of the fuel-air-mixture and having determined the ignition angle, the initial density pi and the ignition angle are weighted in a map at step 250.

Figure 5:
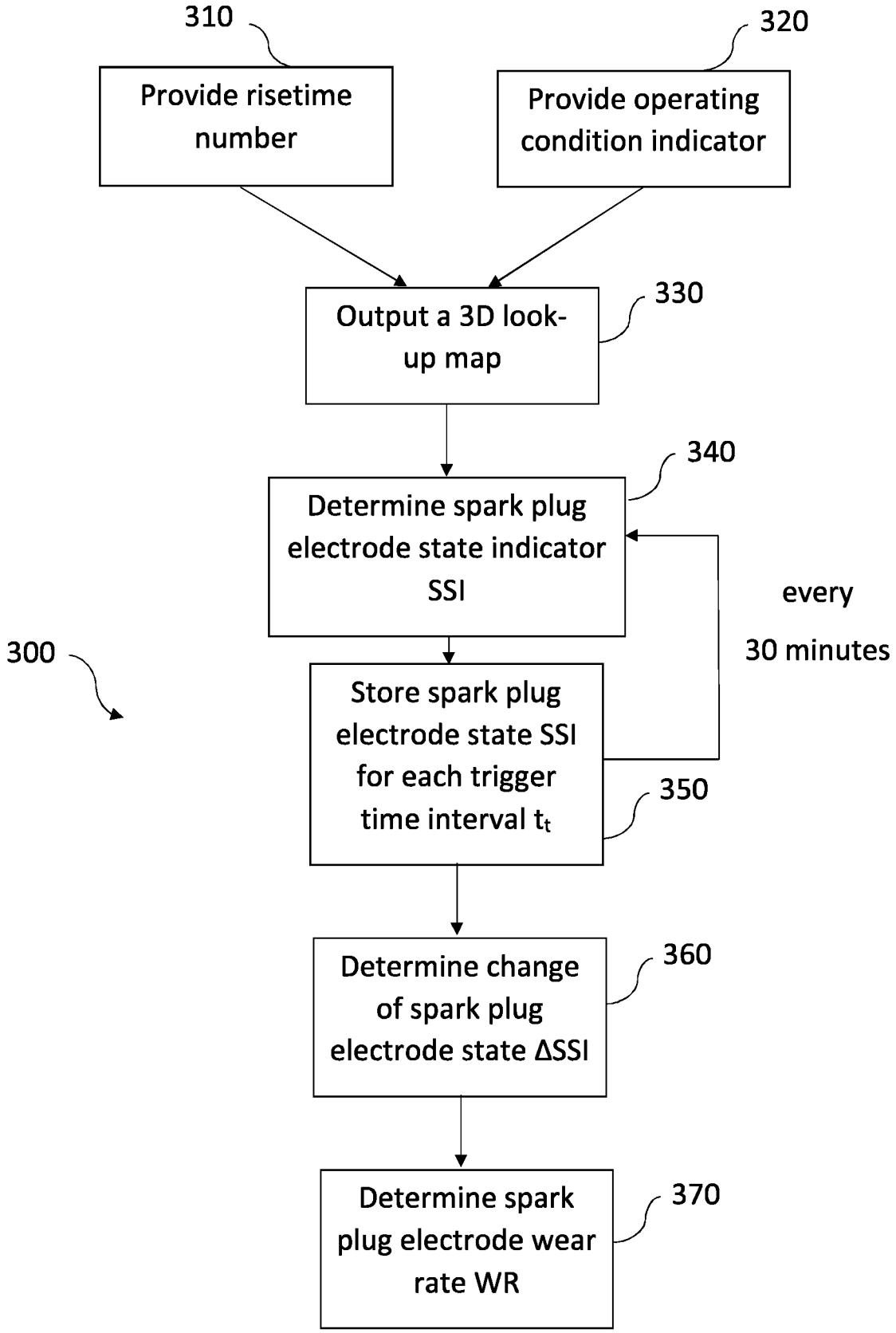
FIG. 5 shows a process chart for determining a spark plug state indicator and a spark plug electrode wear rate according to the present disclosure.

FIG. 5 shows a process chart illustrating the third step 300 of determining the wear rate of the electrode of the spark plug 30 according to the present disclosure, namely determining the spark plug state. For the determination of a spark plug state indicator SSI, the already determined risetime number is taken from the ECM in step 310 and the already determined operating condition indicator is taken from ECM in step 320. Both the risetime number and the operating condition indicator are outputted in a 3D look-up map in step 330.

Figure 6:
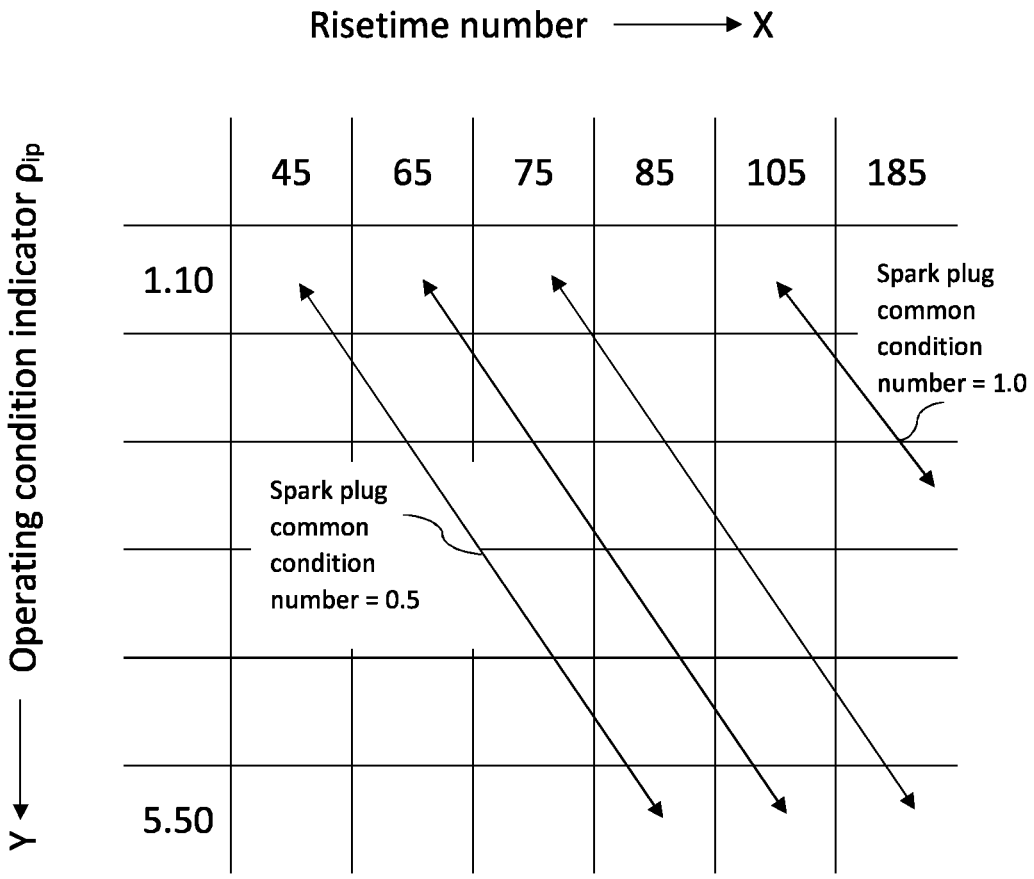
FIG. 6 shows different spark plug electrode states in a 3D look-up map according to the present disclosure.

An exemplary 3D look-up map is shown in FIG. 6. As can be seen in FIG. 6, the risetime number is assigned to the axis of abscissae (X-axis) and the operating condition indicator $\rho_{ip}$ is assigned to the axis of ordinates (Y-axis). In the 3D look-up map, isolines indicate the same state of a spark plug and, thus, its electrodes, and correspond to a "spark plug common condition value". The spark plug common condition value corresponds to a number indicating the state of a spark plug electrode and is determined by calibration based on fundamental investigation, accelerated testing and/or actual behavior of spark plugs over time. The breakdown voltage and the risetime is a function of density in between the two electrodes of the sparkplug and the gap between two electrodes. For a given electrode gap the risetime would increase with increasing density, Thus such isolines represent a same state of electrode gap that represents the dependency of density inbetween the electrodes, i.e, the operating load for the engine. The mode of calibration may vary depending on the application or the ignition system type.

Referring again to the example shown in FIG. 6, a new spark plug may have a spark plug common condition value of 0.5, whereas a completely worn spark plug may have a spark plug common condition value of 1.0. The isoline denoting the new spark plug is situated leftmost and the isoline denoting the worn spark plug is situated rightmost in the 3D look-up map shown in FIG. 6, In other words, the more the spark plug is worn, the more it is positioned and displaced, respectively, to the left in the 3D look-up map of FIG. 6, Referring to the risetime number at the X-axis and the operating condition indicator at the Y-axis, a new spark plug having a spark plug common condition value of 0.5 may have a tow risetime number of around 45 if the ignition density $\rho_{ip}$ of the fuel-air-mixture is low, e.g., approximately 1.10 as may be in case of idle running of the internal combustion engine. On the other hand side, a new spark plug having a spark plug common condition value of 0.5 may have a high risetime number of around 85 if the ignition density $\rho_{ip}$ of the fuel-air-mixture is high, e.g., approximately 5.50 as may be in case of high load operation of the internal combustion engine. To the contrary, a worn spark plug having a spark plug common condition value of 1.0 may have a high risetime number of around 105 if the ignition density $\rho_{ip}$ of the fuel-air-mixture is low, e.g., approximately 1.10 as may be in case of idle running of the internal combustion engine and may have a higher risetime number of around 185 if the ignition density $\rho_{ip}$ of the fuel-air-mixture is higher, e.g., approximately 2.50 as may be in case of normal load operation of the internal combustion engine. As shown in the 3D look-up map of FIG. 6, a spark plug with a completely worn electrode and, thus, a spark plug common condition value of 1.0 can no longer be used for high load operation of the internal combustion engine, because no spark arc may be generated with a spark plug having such worn electrodes.

Referring again to FIG. 5, the spark plug state indicator SSI is determined in predetermined trigger time intervals in step 340, such as every 30 minutes. However, it is also appreciated that the spark plug state indicator SSI is determined every 60 minutes, 600 minutes, etc. A predetermined integral number of spark plug state indicators SSI, however, at least two different spark plug state indicators SSI are stored in a memory in step 350. Preferably, the last five spark plug state indicators SSI are stored in the memory and the oldest spark plug state indicator SSI is replaced by a new spark plug state indicator SSI in form of a ring saving mechanism. The memory is preferably a nonvolatile memory.

As soon as the different spark plug state indicators SSI have been determined by use of the 3D look-up map as shown in FIG. 6 and have been stored in the memory, the wear rate of the monitored spark plug electrode is calculated in step 360 of FIG. 5. In general, the wear rate is calculated as a difference between the current spark plug state indicator $SSI_{n+1}$ and the previous spark plug state indicator $SSI_n$ divided by the time period used as trigger time interval, in the following, the calculation of the wear rate is explained in detail.

First, two subsequent spark plug state indicators SSI are compared with each other in order to determine whether the spark plug state indicator SSI has changed and, if so, how much (ΔSSI). For determining the change of the spark plug state indicator SSI, the following equation is used:

$$\Delta SSI = SSI_{n+1} - SSI_n \quad (1)$$

ΔSSI: change of spark plug state indicator
$SSI_{n+1}$: current spark plug state indicator
$SSI_n$: previous spark plug state indicator
n: trigger time interval number The current spark plug state indicator $SSI_{n+1}$ corresponds to the state of the spark plug electrode which has been determined at the current trigger time and, thus, is a real-time spark plug state indicator $SSI_{n+1}$. The previous spark plug state indicator $SSI_n$ corresponds to the spark plug electrode state which has been determined at the previous trigger time which is the trigger time preceding the current trigger time.

After having determined the change in the spark plug state indicator ΔSSI, the spark plug wear rate is determined by using the following equation:

$$WR = \frac{\Delta SSI}{t_t} \quad (2)$$

WR: wear rate
ΔSSI: change of spark plug state indicator
$t_t$: trigger time interval The trigger time interval may be predetermined by spark plug manufacturer or the engine manufacturer and/or may be selected based on predefined operating conditions of the internal combustion engine (idle running, low or high load operation, etc.), operating characteristics (temperature at spark plug electrodes, risetime, etc.), and the like. For example, the trigger time interval may be 30 minutes, 60 minutes or 600 minutes. However, it is appreciated that any other trigger time interval may be used for determining the wear rate of a spark plug.

As an example, if the current spark plug state indicator $SSI_n$_1 is 0.505 and the previous spark plug state indicator $SSI_n$ is 0.5, the change of the spark plug state indicator ΔSSI is 0.005. If the trigger time interval is 60 minutes, i.e. the spark plug state indicator SSI is measured every hour, the wear rate WR is 0.005 per hour.

The spark plug wear rate may be communicated to the ECM and may be used for further actions, such as condition monitoring, calibrating an engine control or the spark wave form. For example, the spark plug wear rate may be used to determine when a particular spark plug has to be replaced and to indicate the upcoming spark plug replacement to a driver.

Terms such as "about", "around", "approximately", or "substantially" as used herein when referring to a measurable value such as a parameter, an amount, a temporal duration, and the like, is meant to encompass variations of ±10% or less, preferably ±5% or less, more preferably ±1% or less, and still more preferably ±0.1% or less of and from the specified value, insofar as such variations are appropriate to perform in the disclosed invention. It is to be understood that the value to which the modifier "about" refers is itself also specifically, and preferably, disclosed. The recitation of numerical ranges by endpoints includes all numbers and fractions subsumed within the respective ranges, as well as the recited endpoints.

INDUSTRIAL APPLICABILITY

The method and ignition system as disclosed herein are applicable in internal combustion engines for monitoring an ignition system and a state of the spark plug. Particularly, the methods and control systems as disclosed herein may be applied in large internal combustion engines, in which combustion processes of the cylinders may be individually controlled so that cylinders having a spark plug with a reduced sparkability can be further operated under low load conditions to maintain an operation of the affected cylinder until the next maintenance. The method and ignition system as disclosed herein may further assist in pinpointing the reason for a misfire and/or an abnormal behavior of a spark plug.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

Although the preferred embodiments of this invention have been described herein, improvements and modifications may be incorporated without departing from the scope of the following claims.

The invention claimed is:

1. A method for determining the wear rate of a spark plug electrode of an ignition system, the method comprising:

determining a risetime number indicating the time required for raising a primary current and hence an ignition energy which is supplied to an ignition coil of the spark plug from an inactive level to a predetermined level, determining an operating condition indicator indicating an operating condition of the ignition system, and determining a wear rate of the spark plug electrode based on a difference of a first spark plug state indicator indicating the spark plug electrode state at a first time instance and a second spark plug state indicator indicating the spark plug electrode state at a second time instance, wherein:

the first time instance and the second time instance are separated by a predetermined time interval, the spark plug state indicator is determined as a value based on the determined risetime number and the determined operating condition indicator, and the wear rate comprises the difference between he first spark plug state indicator at the first time instance and the second spark plug indicator state at the second time instance divided by the predetermined time interval.

2. The method of claim 1, wherein the risetime number is determined based on a risetime mean value and a risetime standard deviation.

3. The method of claim 1, wherein the operating condition indicator corresponds to an ignition density ($\rho_{ip}$) of a fuel-air-mixture at an ignition time.

4. The method of claim 3, wherein the ignition density ($\rho_{ip}$) is determined based on an initial density ($\rho_i$) of a fuel air-mixture and an ignition angle.

5. The method of claim 4, wherein the initial density ($\rho_i$) of a fuel-air-mixture is determined based on one or more operating condition signals indicating one or more operating conditions of the ignition system.

6. The method of claim 5, wherein the operating condition signals include an intake manifold pressure and an intake manifold temperature.

7. The method of claim 4, wherein the ignition angle is determined in real-time.

8. The method of claim 4, wherein the ignition angle is determined based on a look-up table.

9. The method of claim 1, wherein spark plug state indicator is stored in the memory at regular intervals such as intervals between 1 and 600 minutes.

10. The method of claim 1, wherein a predetermined integral number of spark plug state indicators is stored in the memory.

11. An ignition system for an internal combustion engine, comprising:

at least one spark plug, an ignition coil for the at least one spark plug, a control unit electronically connected to the ignition coil and configured to perform a method for determining a wear rate of the spark plug electrode of the ignition system, the method comprising:

determining a risetime number indicating the time required for raising a primary current and hence an ignition energy which is supplied to an ignition coil of the spark plug from an inactive level to a predetermined level;

determining an operating condition indicator indicating an operating condition of the ignition system; and determining a wear rate of the spark plug electrode based on a difference of a first spark plug state indicator indicating the spark plug electrode state at a first time instance and a second spark plug state indicator indicating the spark plug electrode state at a second time instance, wherein:

the first time instance and the second time instance are separated by a predetermined time interval, the spark plug state indicator is determined as a value based on the determined risetime number and the determined operating condition indicator, the wear rate comprises the difference between he first spark plug state indicator at the first time instance and the second spark plug indicator state at the second time instance divided by the predetermined time interval; and the risetime number is determined based on a risetime mean value and a risetime standard deviation.

12. An electronic control module configured to perform a method to determine a wear state of a spark plug electrode of an ignition system, comprising:

determining a risetime number indicating the time required for raising a primary current and hence an ignition energy which is supplied to an ignition coil of the spark plug from an inactive level to a predetermined level;

determining an operating condition indicator indicating an operating condition of the ignition system; and determining a wear rate of the spark plug electrode based on a difference of a first spark plug state indicator indicating the spark plug electrode state at a first time instance and a second spark plug state indicator indicating the spark plug electrode state at a second time instance, wherein:

the first time instance and the second time instance are separated by a predetermined time interval, the spark plug state indicator is determined as a value based on the determined risetime number and the determined operating condition indicator, the wear rate comprises the difference between he first spark plug state indicator at the first time instance and the second spark plug indicator state at the second time instance divided by the predetermined time interval;

the operating condition indicator corresponds to an ignition density ($\rho_{ip}$) of a fuel-air-mixture at an ignition time; and the ignition density ($\rho_{ip}$) is determined based on an initial density ($\rho_i$) of a fuel air-mixture and an ignition angle.

13. The method of claim 1, further comprising:

processing the determined wear rate to determine a lifespan of the spark plug electrode.

14. The method of claim 1, further comprising:

using the determined wear rate to calibrate an engine control.

15. The method of claim 1, further comprising:

using the determine wear rate to determine a spark wave form to be applied to the spark plug electrode.

16. The method of claim 13, further comprising:

using the determined lifespan of the spark plug electrode to determine whether to operate the spark plug electrode under low load conditions to maintain operation of the spark plug electrode until a next maintenance of the spark plug electrode.

* * * * *